US005572973A

United States Patent [19]

Schenk

[11] Patent Number: 5,572,973

[45] Date of Patent: Nov. 12, 1996

[54] METHOD FOR CYLINDER IDENTIFICATION IN AN INTERNAL COMBUSTION ENGINE WHEN IDLING

[75] Inventor: Klaus Schenk, Bietigheim-Bissingen, Germany

[73] Assignee: Robert Bosch GmbH, Stuttgart, Germany

[21] Appl. No.: 397,105

[22] PCT Filed: Nov. 27, 1993

[86] PCT No.: PCT/DE93/01134

§ 371 Date: Mar. 6, 1995

§ 102(e) Date: Mar. 6, 1995

[87] PCT Pub. No.: WO94/13951

PCT Pub. Date: Jun. 23, 1994

[30] Foreign Application Priority Data

Dec. 16, 1992 [DE] Germany ..... 42 42 419.4

[51] Int. Cl.[6] ..... F02P 5/00

[52] U.S. Cl. ..... 123/414

[58] Field of Search ..... 123/414, 416, 123/415, 417, 418, 339.1, 339.11; 73/116, 117.3, 119 A; 364/431.07

[56] References Cited

U.S. PATENT DOCUMENTS

| | | | |
|---|---|---|---|
| 4,558,591 | 12/1985 | Francis et al. . | |
| 5,085,191 | 2/1992 | Okuda | 123/414 |
| 5,099,810 | 3/1992 | Borst | 123/414 |
| 5,099,811 | 3/1992 | Frantz et al. | 123/416 |
| 5,209,202 | 5/1993 | Maurer et al. | 123/414 |
| 5,213,079 | 5/1993 | Umemoto et al. | 123/414 |
| 5,239,962 | 8/1993 | Fukui et al. | 123/414 |
| 5,263,450 | 11/1993 | Hashimoto et al. | 123/414 |
| 5,269,274 | 12/1993 | Flaetgen et al. | 123/414 |
| 5,291,409 | 3/1994 | Richardson et al. | 364/431.07 |
| 5,333,586 | 8/1994 | Fukui | 123/414 |

FOREIGN PATENT DOCUMENTS

| | | |
|---|---|---|
| 203 576 | 12/1986 | European Pat. Off. . |
| 425 953 | 5/1991 | European Pat. Off. . |
| 34 31 232 | 3/1985 | Germany . |
| WO89/08778 | 9/1989 | WIPO . |
| WO90/15926 | 12/1990 | WIPO . |

*Primary Examiner*—Raymond A. Nelli
*Attorney, Agent, or Firm*—Kenyon & Kenyon

[57] ABSTRACT

A method for identifying cylinders in the case of a missing or faulty phase signal during the idling operation of internal combustion engines in which, an ignition spark is produced with every crankshaft in every cylinder, and the specified ignition-advance angle of the idling control for at least one ignition of each cylinder is altered in every second crankshaft rotation. The reaction to the change in the ignition-advance angle in the advance direction or toward a later firing point is subsequently evaluated by detecting irregular running or by monitoring the air pilot control value and by undertaking an appropriate cylinder allocation.

9 Claims, 4 Drawing Sheets

METHOD FOR CYLINDER IDENTIFICATION IN AN INTERNAL COMBUSTION ENGINE WHEN IDLING

FIELD OF THE INVENTION

The present invention relates to a method for identifying cylinders in internal combustion engines.

BACKGROUND INFORMATION

For cylinder identification, i.e., to detect the compression in one cylinder, for example, cylinder 1 of the engine, during one working cycle, the German Published Patent Application No. 34 31 232 has already disclosed providing two sensor wheels, the first sensor wheel turning at crankshaft speed and the second sensor wheel turning at half of the crankshaft speed, which is the speed of the camshaft. By synchronizing the signals generated in the sensors assigned to the sensor wheels, one is able to exactly identify which stroke of the combustion cycle the engine is in. With this method, when the sensor used to detect camshaft revolution fails, one can no longer identify the exact position of the piston of one cylinder during one combustion cycle because of the missing phase signal.

SUMMARY OF THE INVENTION

In contrast, the method according to the present invention, has the advantage of enabling a cylinder identification even without the existence of phase signals. An additional advantage to be considered is that, in particular, feedback controls performed on individual cylinders, such as a cylinder-selective injection or a cylinder-selective knock control, can be continued even when there is a phase-sensor error. Last of all, it is advantageous that safety measures for an operation under emergency conditions, such as a late ignition-advance angle and mixture-enriching, can be eliminated or can be ended after a short time. Until the time that the reference mark is allocated and, thus, until cylinder identification, it is especially advantageous for safety measures to be activated, and then inactivated after the cylinder identification. It is, thus, advantageous for one ignition signal to be output in every crankshaft revolution, so that one ignition signal then takes place during the compression stroke which can, consequently, trigger a combustion.

DETAILED DESCRIPTION

Figure 1:
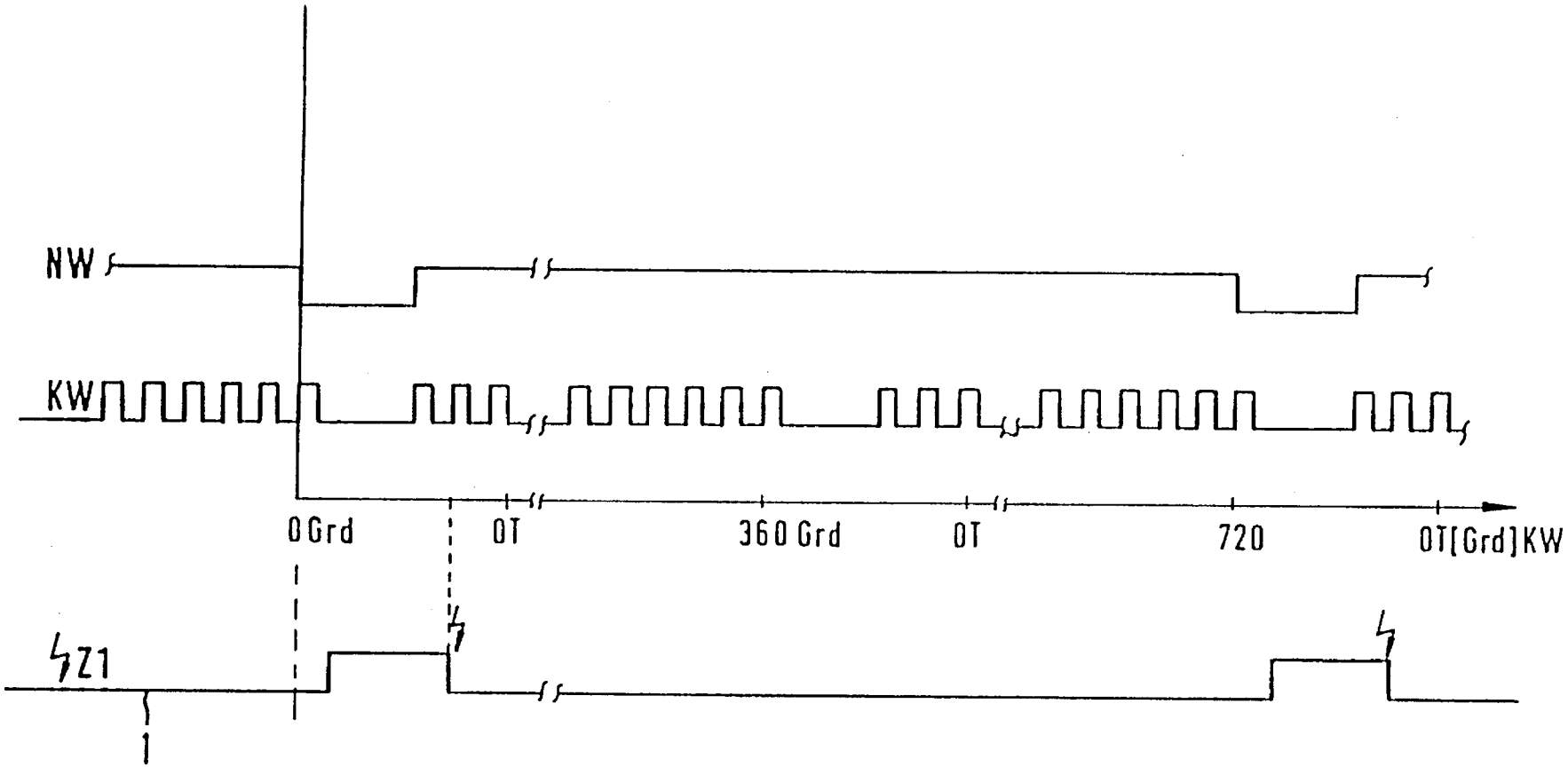
FIG. 1 shows the correlation between the camshaft and crankshaft signal on the basis of signal patterns.
Figure 4:
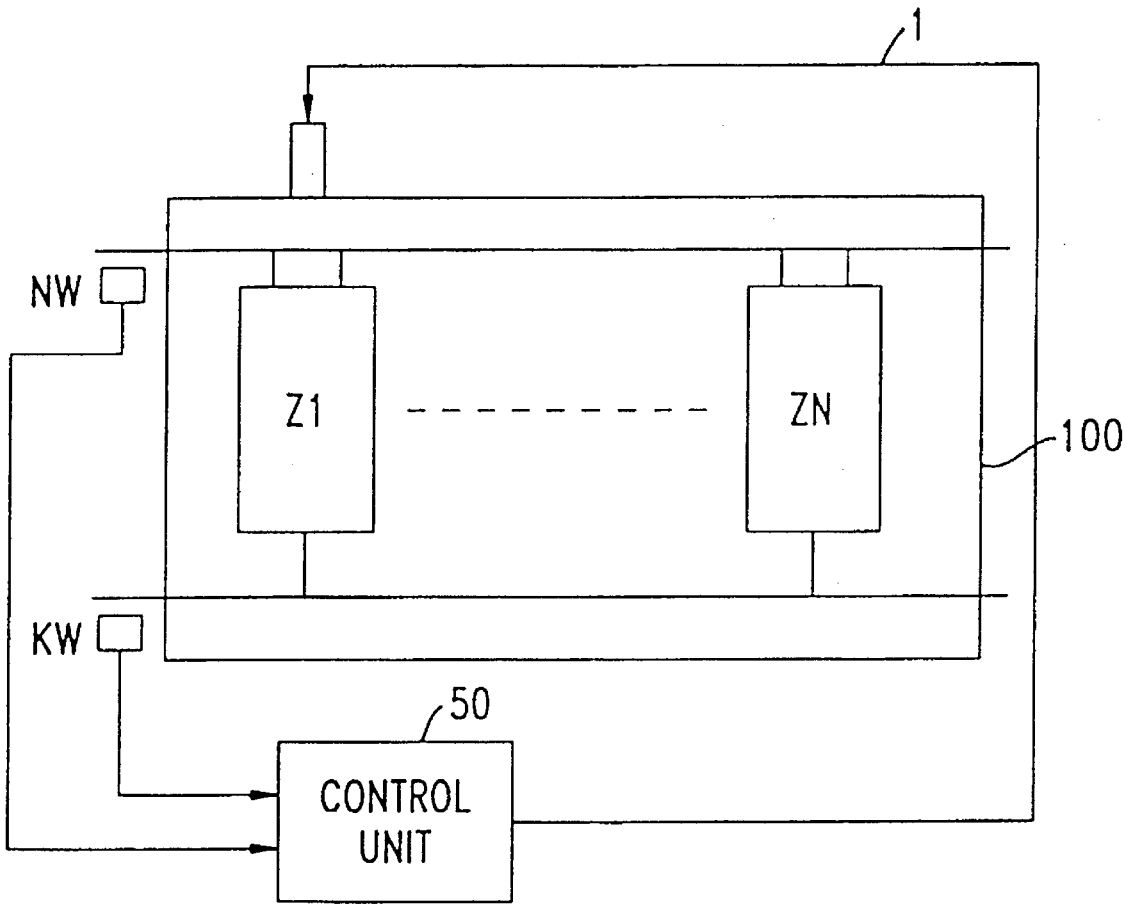
FIG. 4 is a block diagram of an exemplary embodiment of a system for carrying out a method in accordance with the present invention.

FIG. 1 depicts the signal patterns from the camshaft sensor NW and from the crankshaft sensor KW as a first and second signal pattern for a multicylinder internal combustion engine 100, as detected by a control unit 50 under normal operational conditions. FIG. 4 shows the arrangement of the engine 100, sensors NW and KW and the control unit 50. The ignition-control signal 1 output at a first cylinder Z1 by the control unit is shown in FIG. 1 as a third signal pattern. All three signal patterns NW, KW and the ignition-control signal 1 are depicted over the arc of crankshaft rotation, the intention being to elucidate, in particular, the range of 0° to 720° (thus, two crankshaft revolutions). As is generally known, the crankshaft of a four-stroke internal combustion engine turns twice around its own axis during one combustion cycle. Accordingly, the piston moves twice in the direction of its top dead center and, in fact, once during the compression stroke and, the other time, during the exhaust stroke. To ensure proper combustion, it is important for the spark plug ignition to take place during the compression stroke and not during the exhaust stroke, since otherwise the induction pipe would be at risk. The crankshaft is usually connected to a sensor wheel, which is comprised of, for example, 60 - 2 teeth, to detect one complete crankshaft revolution. The camshaft of an internal combustion engine turns at half of the crankshaft speed, so that one camshaft revolution is completed for two crankshaft revolutions. From this, a synchronization can easily be performed in the normal case between the camshaft signal NW and the crankshaft signal KW, to subsequently trigger the ignition pulse during the correct stroke of the combustion cycle. When the gap on the camshaft sensor wheel and on the crankshaft sensor wheel are detected as being simultaneously present, the position of the internal combustion engine can be identified, and the next ignition pulse can be properly allocated to the corresponding cylinder which is in the compression stroke.

Figure 2:
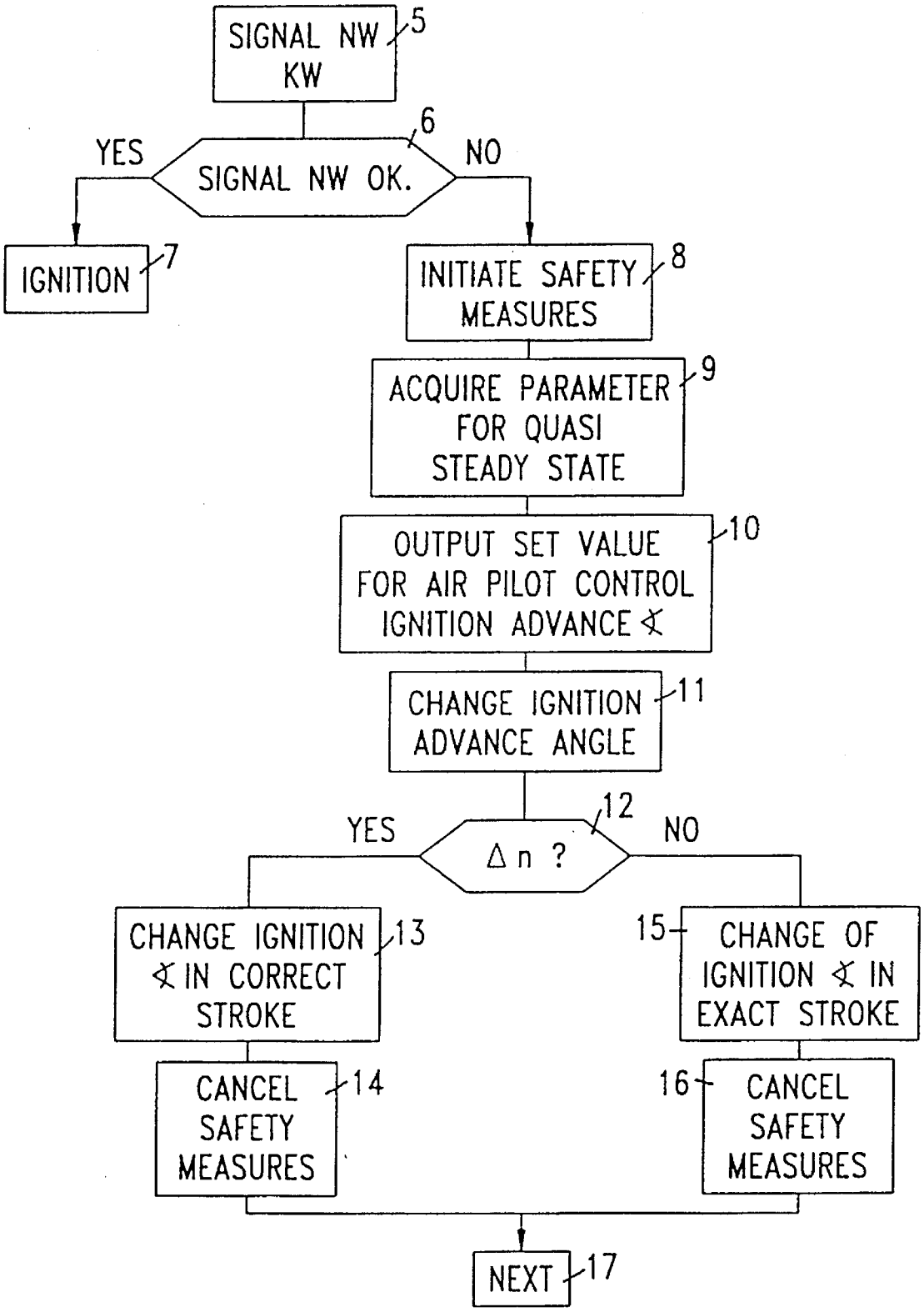
FIG. 2 shows a flow chart of a first exemplary embodiment of the method according to the present invention.

FIG. 2 depicts a first exemplary embodiment of the method according to the present invention for identifying cylinders during idling operation. The signals supplied by the sensors allocated to the sensor wheels, such as the camshaft signal NW and the crankshaft signal KW, are detected in step 5. A subsequent query 6 controls whether the phase signal of the camshaft NW was in order. If this is the case, i.e., if both the crankshaft signal KW as well as the camshaft signal NW are available for outputting the ignition, then in step 7, after the camshaft signal and the crankshaft signal have appeared, the ignition is output during the corresponding stroke of the combustion cycle for each cylinder. If the response to the query 6 was negative, i.e., the camshaft signal was missing or was incorrect, then safety measures for an operation under emergency conditions are initiated in step 8. These safety measures M1, M2 and M3 comprise, for example, outputting safety ignition-advance angles for a knock control, mixture enriching, and outputting double ignitions, i.e., an ignition pulse is released each time before the top dead center is reached. By acquiring the appropriate operating parameters of the internal combustion engine, step 9 ensures that the internal combustion engine is working in a quasi steady-state condition. Subsequently in step 10, fixed values for the air pilot control as well as for the ignition-advance angle are output for the steady-state condition of the idling operation of the internal combustion engine with the effect that the idling speed is slightly increased. This is necessary to prevent the engine from stalling when a load, such as air conditioning, is connected. The ignition-advance angle is output so as to allow a change in the ignition-advance angle to result directly in a change in speed. Subsequently in step 11, the ignition-advance angle of one of the two ignitions per combustion cycle, for example of a double ignition at the cylinder 1, is altered by shifting it in the advance direction or toward a later firing point. Query 12 subsequently evaluates irregular running and controls whether a change in speed has occurred. An affirmative response in query 12, i.e., that a speed change n was determined on the basis of a change in the ignition-advance angle in the advance direction or toward a later firing point, leads to step 13. It is established here on the basis of the change in speed that the ignition-advance angle that had been altered took place during the correct stroke of the combustion cycle, given a proper ignition. Thus, the ignition can be allocated to the cylinder 1, and the safety measures introduced in step 8 for an operation under emergency conditions, M1, M2 and M3, are again canceled. A negative response to query 12, i.e., no change in engine speed was able to be determined, leads in the work step 15 to the control unit recognizing that the output ignition took place with the change in the ignition-advance angle during the change-in-charge stroke (exhaust stroke), so that the change in the ignition-advance angle must have remained without consequence for the speed.

After the cylinder is synchronized, the next ignition is output by the control unit during the compression stroke, having been displaced by 360° arc of crankshaft rotation. The safety measures for an operation under emergency conditions are canceled in a subsequent step 16. Steps 14 and 16 lead to step 17, which again controls whether the phase signal was in order. When making the transition from idling LL to part throttle running, the calculation is continued with the corresponding gap as a cylinder allocation, otherwise no additional measures are carried out.

Figure 3:
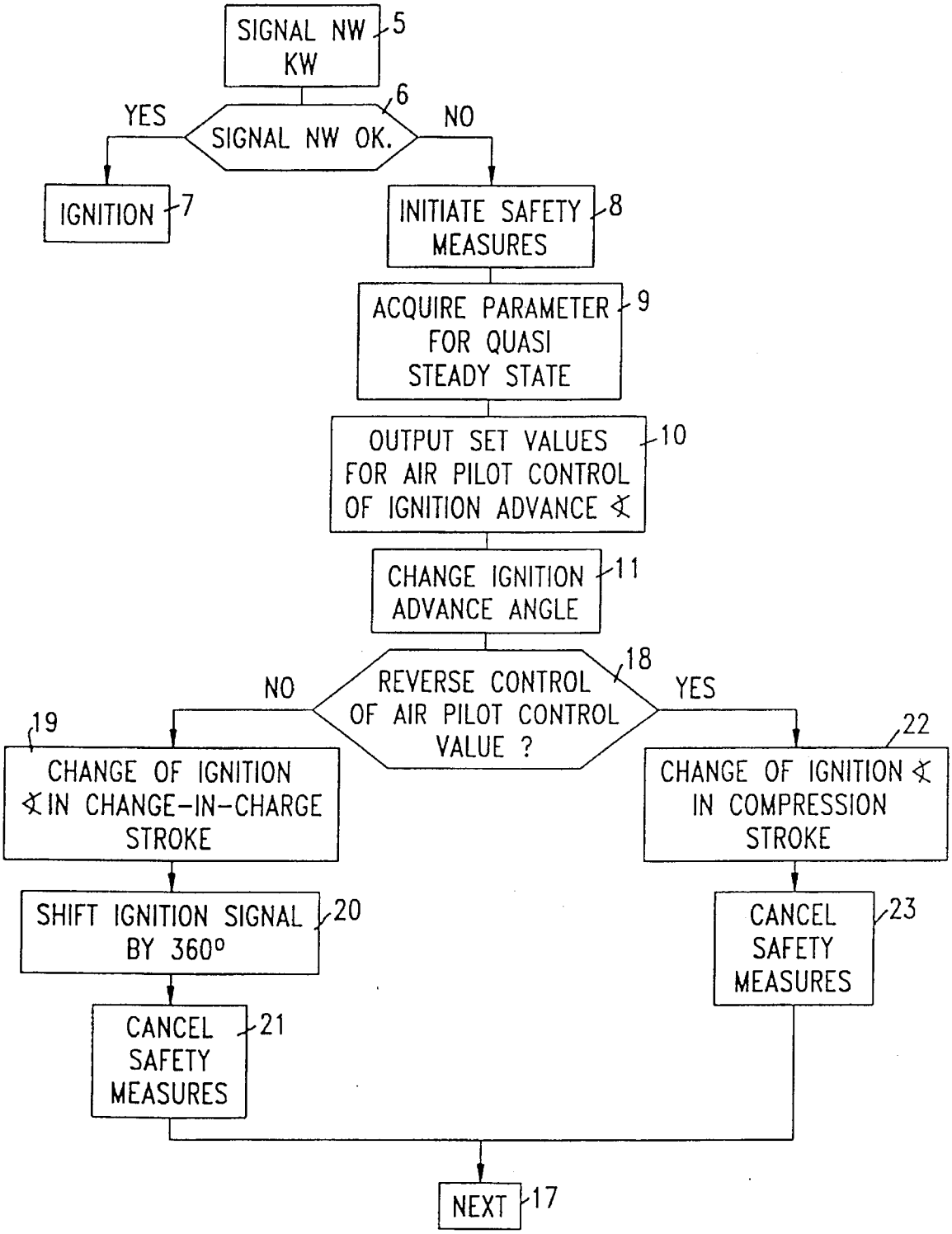
FIG. 3 illustrates a flow chart of a second exemplary embodiment of the method according to the present invention.

A second exemplary embodiment of cylinder allocation shall be clarified in FIG. 3 for the idle running operation of an internal combustion engine in the case of a missing or faulty phase signal. The initial part of this method is identical to the method described in FIG. 2, so that steps 5 through 11 do not have to be explained again. After the ignition-advance angle of each second ignition is changed per crankshaft revolution in the work step 11, a work step 18 controls whether the change in the ignition-advance angle has effected a reverse control of the air pilot control value for the idling speed. If this is not the case, thus, the response to the query 18 was negative, then in a subsequent step 19, the altered ignition is assigned to the change-in-charge stroke. Thus, for the next ignition, the ignition signal is displaced by 360° toward the previously changed ignition in step 20. After allocation of the ignition to the corresponding stroke of the combustion cycle, the safety measures for an operation under emergency conditions can be canceled in step 21. An affirmative response to the query 18, i.e., that the change in the ignition-advance angle effected a change in the air pilot-control value, leads to step 22, in which the ignition with the altered ignition-advance angle is recognized as an ignition in the compression stroke. The output ignition was thus in order. The safety measures M1, M2 and M3 can be canceled in step 23. Steps 21 and 23 of this method are joined to step 24.

The ignition or the injection are now triggered by the control unit using the ascertained cylinder allocation until the next control-unit reset. After that, the process begins anew, whereby in step 24, the system jumps back to the beginning of the process.

I claim:

1. A method for identifying cylinders of an internal combustion engine in a quasi steady-state condition of the engine and for controlling at least one cyclically repeating operation of the engine, comprising the steps of:

detecting an arc of a rotation of a crankshaft using a sensor associated with the crankshaft, and generating a first signal based thereon;

detecting a reference mark applied to the crankshaft using the sensor, and generating a second signal based thereon;

processing the first and second signals;

altering an ignition-advance angle of at least one cylinder of the engine for a predetermined number of ignition cycles;

detecting a change in a speed of rotation of the engine;

assigning an ignition having the altered ignition-advance angle to a compression stroke of the at least one cylinder;

assigning the reference mark to a reference cylinder of the engine; and controlling the at least one cyclically repeating operation of the engine in accordance with the assignment of the reference mark to the reference cylinder.

2. The method according to claim 1, wherein the quasi steady-state condition includes idling operation of the engine.

3. The method according to claim 1, wherein the cyclically repeating operation includes at least one of ignition and fuel injection processes.

4. The method according to claim 1, wherein the ignition-advance angle is altered by one of shifting the ignition-advance angle in an advance direction and shifting the ignition-advance angle toward a later firing point in each additional crankshaft rotation.

5. The method according to claim 1, further comprising the steps of:

maintaining the quasi steady-state condition of the engine after the ignition-advance angle has been altered; and assigning the ignition having the altered ignition-advance angle to an exhaust stroke of the at least one cylinder after the quasi steady-state condition is maintained.

6. A method for identifying cylinders of an internal combustion engine in a quasi steady-state condition of the engine and for controlling at least one cyclically repeating operation of the engine, comprising the steps of:

detecting an arc of a rotation of a crankshaft using a sensor operatively coupled to the crankshaft, and generating a first signal based thereon;

detecting a reference mark applied to the crankshaft using the sensor, and generating a second signal based thereon;

providing an ignition signal as a function of the first and second signals;

establishing an air pilot control value for the quasi steady-state condition;

altering an ignition-advance angle of at least one cylinder of the engine for a predetermined number of ignition cycles;

monitoring the air pilot control value in order to detect a change in the air pilot control value;

assigning an ignition having the altered ignition-advance angle to a compression stroke of the at least one cylinder and assigning the reference mark to a reference cylinder of the engine when the change in the air pilot control value is detected; and controlling the at least one cyclically repeating operation of the engine in accordance with the assignment of the reference mark to the reference cylinder.

7. The method according to claim 6, wherein the ignition-advance angle is altered by one of shifting the ignition-advance angle in an advance direction and shifting the ignition-advance angle toward a later firing point in each additional crankshaft rotation.

8. The method according to claim 6, further comprising the step of:

activating safety measures until the reference mark is assigned to the reference cylinder.

9. The method according to claim 8, wherein the safety measures are activated by providing the ignition signal in each revolution of the crankshaft.

* * * * *